US011441245B2

(12) United States Patent
Morales

(10) Patent No.: US 11,441,245 B2
(45) Date of Patent: Sep. 13, 2022

(54) RIP-STOP FABRIC WITH MECHANICAL STRETCH FIBERS

(71) Applicant: 5.11, Inc., Irvine, CA (US)

(72) Inventor: Francisco J. Morales, Newport Beach, CA (US)

(73) Assignee: 5.11, INC., Irvine, CA (US)

( * ) Notice: Subject to any disclaimer, the term of this patent is extended or adjusted under 35 U.S.C. 154(b) by 0 days.

(21) Appl. No.: 15/858,558

(22) Filed: Dec. 29, 2017

(65) Prior Publication Data

US 2018/0119318 A1 May 3, 2018

Related U.S. Application Data

(63) Continuation-in-part of application No. 15/464,179, filed on Mar. 20, 2017, which is a continuation of application No. 13/602,745, filed on Sep. 4, 2012, now Pat. No. 9,637,845.

(60) Provisional application No. 61/530,342, filed on Sep. 1, 2011.

(51) Int. Cl.

| | |
|---|---|
| ***D03D 1/00*** | (2006.01) |
| ***D06B 1/00*** | (2006.01) |
| ***D03D 13/00*** | (2006.01) |
| ***D03D 15/47*** | (2021.01) |
| ***D03D 15/56*** | (2021.01) |

(52) U.S. Cl.

CPC ..... *D03D 1/00* (2013.01); *D03D 1/0035* (2013.01); *D03D 13/004* (2013.01); *D03D 15/47* (2021.01); *D03D 15/56* (2021.01); *D06B 1/00* (2013.01); *D10B 2201/02* (2013.01); *D10B 2201/20* (2013.01); *D10B 2331/04* (2013.01); *D10B 2501/04* (2013.01); *D10B 2507/00* (2013.01); *Y10T 442/3065* (2015.04)

(58) Field of Classification Search

CPC ..... D03D 1/00; D03D 1/0035
USPC ..... 2/227
See application file for complete search history.

(56) References Cited

U.S. PATENT DOCUMENTS

| | | | | |
|---|---|---|---|---|
| 3,452,411 | A * | 7/1969 | Brown | D02G 3/328 28/156 |
| 4,636,426 | A * | 1/1987 | Fleischer | D21F 1/0027 139/383 A |
| 6,689,461 | B2 | 2/2004 | Koyanagi et al. | |
| 6,805,957 | B1 * | 10/2004 | Santos | F41H 3/00 428/400 |
| 7,498,280 | B2 | 3/2009 | Debenedictis et al. | |

(Continued)

FOREIGN PATENT DOCUMENTS

| | | |
|---|---|---|
| CN | 1585842 | 2/2005 |
| HK | 1197279 | 7/2018 |

(Continued)

OTHER PUBLICATIONS

U.S. Appl. No. 15/464,179, "Final Office Action", dated May 15, 2019, 9 pages.

(Continued)

*Primary Examiner* — Alissa J Tompkins
*Assistant Examiner* — Catherine M Ferreira
(74) *Attorney, Agent, or Firm* — Kilpatrick Townsend & LLP

(57) ABSTRACT

Rip-stop pants include waist and leg portions formed of ripstop fabric having synthetic mechanical-stretch filament yarns interwoven into spun, staple yarns in a ripstop pattern.

13 Claims, 5 Drawing Sheets

(56) References Cited

U.S. PATENT DOCUMENTS

| | | | | |
|---|---|---|---|---|
| 9,637,845 | B2 | 5/2017 | Morales | |
| 2003/0092339 | A1 | 5/2003 | Covelli et al. | |
| 2003/0203690 | A1* | 10/2003 | Hess | D02G 3/443 442/181 |
| 2003/0228812 | A1 | 12/2003 | Stanhope et al. | |
| 2004/0055660 | A1* | 3/2004 | Heiman | D03D 15/00 139/420 R |
| 2004/0209051 | A1 | 10/2004 | Santos et al. | |
| 2005/0109418 | A1 | 5/2005 | Liao et al. | |
| 2005/0214501 | A1 | 9/2005 | Baychar | |
| 2006/0084337 | A1 | 4/2006 | Corner et al. | |
| 2006/0128243 | A1* | 6/2006 | Kong | D03D 15/08 442/182 |
| 2006/0150610 | A1 | 7/2006 | Negola | |
| 2006/0228964 | A1 | 10/2006 | Watkins et al. | |
| 2007/0135009 | A1* | 6/2007 | Liao | D03D 15/08 442/209 |
| 2009/0193584 | A1 | 8/2009 | Stewart et al. | |
| 2009/0233507 | A1 | 9/2009 | Gross et al. | |
| 2011/0070412 | A1 | 3/2011 | Ly et al. | |
| 2011/0091412 | A1 | 4/2011 | Wittrup et al. | |
| 2017/0231303 | A1 | 8/2017 | Morales | |

FOREIGN PATENT DOCUMENTS

| | | |
|---|---|---|
| JP | 07082629 | 3/1995 |
| JP | 2000008247 | 1/2000 |
| JP | 2002004145 | 1/2002 |
| WO | 03042438 | 5/2003 |
| WO | 2006088538 | 8/2006 |

OTHER PUBLICATIONS

EP12762476.5, "Office Action", dated Jul. 11, 2019, 3 pages.
U.S. Appl. No. 15/464,179, Non-Final Office Action, dated Jul. 10, 2020, 13 pages.
Application No. EP12762476.5, Second Office Action, dated May 7, 2020, 4 pages.
U.S. Appl. No. 15/464,179 , Final Office Action, dated Mar. 12, 2021, 13 pages.
U.S. Appl. No. 15/464,179, Advisory Action, dated Jun. 17, 2021, 4 pages.
U.S. Appl. No. 13/602,745, "Final Office Action", dated Jun. 25, 2015, 9 pages.
U.S. Appl. No. 13/602,745, "Non-Final Office Action", dated Dec. 22, 2015, 11 pages.
U.S. Appl. No. 13/602,745, "Non-Final Office Action", dated Dec. 19, 2014, 8 pages.
U.S. Appl. No. 13/602,745, "Notice of Allowance", dated Jan. 9, 2017, 10 pages.
U.S. Appl. No. 13/602,745, "Final Office Action", dated May 16, 2016, 13 pages.
U.S. Appl. No. 15/464,179, "Advisory Action", dated Apr. 11, 2018, 4 pages.
U.S. Appl. No. 15/464,179, "Final Office Action", dated Dec. 26, 2017, 12 pages.
U.S. Appl. No. 15/464,179, "Non-Final Office Action", dated Aug. 10, 2018, 12 pages.
U.S. Appl. No. 15/464,179, "Non-Final Office Action", dated Jun. 2, 2017, 12 pages.
CN201280042588.6, "Office Action", dated Oct. 8, 2014, 15 pages.
CN201280042588.6, "Office Action", dated Jul. 1, 2015, 17 pages.
CN201280042588.6, "Office Action", dated Oct. 9, 2016, 17 pages.
CN201280042588.6, "Office Action", dated Jan. 21, 2016, 22 pages.
CN2012800425886, "Notice on Grant of Patent Right for Invention", dated May 3, 2017, 4 pages.
Congyang et al., "Discussion on Dyeing and Finishing of T-400 Polyurethane Interwoven Fabric", Dyeing and Finishing Technology, vol. 28, No. 6, Jun. 2006, pp. 20-22.
PCT/US2012/053696, "International Search Report and Written Opinion", dated Nov. 7, 2012, 10 pages.
Tortora et al., "Fairchild's Dictionary of Textile", 7th Edition, Fairchild Publications New York, Apr. 28, 2015, 3 pages.
Xiaojin, "Dyeing and Finishing of Bamboo Fiber Polyurethane/T-400 Dual Elastic Fabrics", Printing and Dyeing, No. 24, Nov. 2007, pp. 13-15.
Yan et al., "Development of Functional T-400 Yarn-Dyed Fabric and Comparison of Wearability", Scientific Research and Practice, No. 1, Article No. 1672, Mar. 2006, pp. 1-3.
U.S. Appl. No. 15/464,179, Non-Final Office Action, dated Nov. 17, 2021, 12 pages.

* cited by examiner

RIP-STOP FABRIC WITH MECHANICAL STRETCH FIBERS

CROSS-REFERENCES TO RELATED APPLICATIONS

This application is a Continuation-in-Part of U.S. application Ser. No. 15/464,179, filed Mar. 20, 2017, which application is a continuation of U.S. patent application Ser. No. 13/602,745, filed Sep. 4, 2012, now issued U.S. Pat. No. 9,637,845, issued May 2, 2017, which application claims the benefit of U.S. Provisional Application No. 61/530,342, filed Sep. 1, 2011, the entire contents of which are hereby incorporated in their entirety for all purposes.

BACKGROUND

Rip-stop woven fabrics are commonly used for military and police uniforms and most rip-stop fabrics used for police and military uniforms are made in blends of polyester/cotton, cotton/polyester, and nylon/cotton. The strength, ease of care, and fade-resistance properties of rip-stop fabrics for police and military uniforms have been enhanced by this blending of polyester or nylon with cotton. Stain and water resistant finishes can be applied to the fabrics to further improve durability and ease of care.

A key requirement for rip-stop fabrics used for police and military uniforms is for them to be able to withstand 50+ washes and extensive field used while still delivering comfort to the wearer. Therefore, durability and comfort become the two most important attributes of these fabrics.

A very popular way to add comfort to a fabric is by adding stretch. Commonly, stretch has been added to fabrics by using elastic fibers, such as spandex or elastane fibers. Spandex fibers present technical challenges when used in fabrics with a polyester content higher than 40%, because spandex fiber degrades during the dyeing process as the polyester is dyed at higher temperatures than cotton or other cellulosic-based materials. In addition, spandex fibers can further degrade when stain repellant finishes are added to the fabric as they are heat-set during the finishing stage.

Further, the extensive washing cycles that police and military uniforms go through further degrade the spandex in fabric, reducing the usable life of the fabric. As a result, all the rip-stop fabrics made for police and military uniforms today that are made in polyester/cotton or nylon/cotton blends do not offer stretch properties.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein are directed to a rip-stop fabric incorporating mechanical stretch fibers, as opposed to elastic stretch fibers such as spandex.

In embodiments, the rip-stop woven fabric made with at least two type of yarns. The first yarn is spun from an intimate blend of staple/commercially-available fibers, with one of the fibers being cellulose-based (e.g., cotton or rayon) and the other fiber being polyester, nylon, or modacrilic. The second yarn is a filament multi-component polyester yarn or elasterell-p multi-component filament yarn.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Embodiments herein are directed to a rip-stop fabric that features the combination of mechanical stretch, rip-stop weave, and fade resistance.

According to some embodiments, a rip-stop woven fabric is made with at least two type of yarns. The first yarn is spun from an intimate blend of staple/commercially-available fibers, with one of the fibers being cellulose-based (e.g., cotton or rayon) and the other fiber being polyester, nylon, or modacrilic (hereinafter "spun fibers" or "spun yarns"). The second yarn is a mechanical stretch yarn, such as a filament multi-component polyester yarn, elasterell-p multi-component filament yarn (hereinafter "multi-component polyester filament yarns" or "multi-component polyester filament fibers"), or a side-by-side mechanical stretch yarn (e.g., a bicomponent filament yarn in which two component sub-filaments having different melting points or different molecular weights are fused alongside each other, as opposed to core/sheathe, tipped, or segmented filaments). In a side-by-side mechanical stretch yarn, the two component sub-filaments contract at different rates, causing the final filament to assume a zig-zag, spring-like nature resulting in "mechanical" stretch properties, like those of a spring. Because this structure is inherent in the material and not a result of mechanical manipulation, the mechanical stretch properties of the filaments, and the mechanical stretch yarn made therefore, remain in the yarn permanently. Such mechanical stretch yarns provide a mechanical stretch property for the rip-stop fabric.

Elasterell, or elasterell-p is a specific subclass of mechanical stretch fibers including inherently elastic, multi-component polyester filament fibers. The U.S. Federal Trade Commission defines "elasterell-p" as fiber formed by the interaction of two or more chemically distinct polymers (of which none exceeds 85% by weight) which contains ester groups as the dominant functional unit (at least 85% by weight of the total polymer content of the fiber) and which, if stretched at least 100%, durably and rapidly reverts substantially to its unstretched length when the tension is removed. Although elasteral-p is described in embodiments, other mechanical stretch yarns may be used.

The multi-component filament yarn adds stretch properties to the rip-stop fabric while being able to withstand high dyeing and finishing temperatures, thereby eliminating the need to use spandex and overcoming the durability limitations of spandex.

Figure 1:
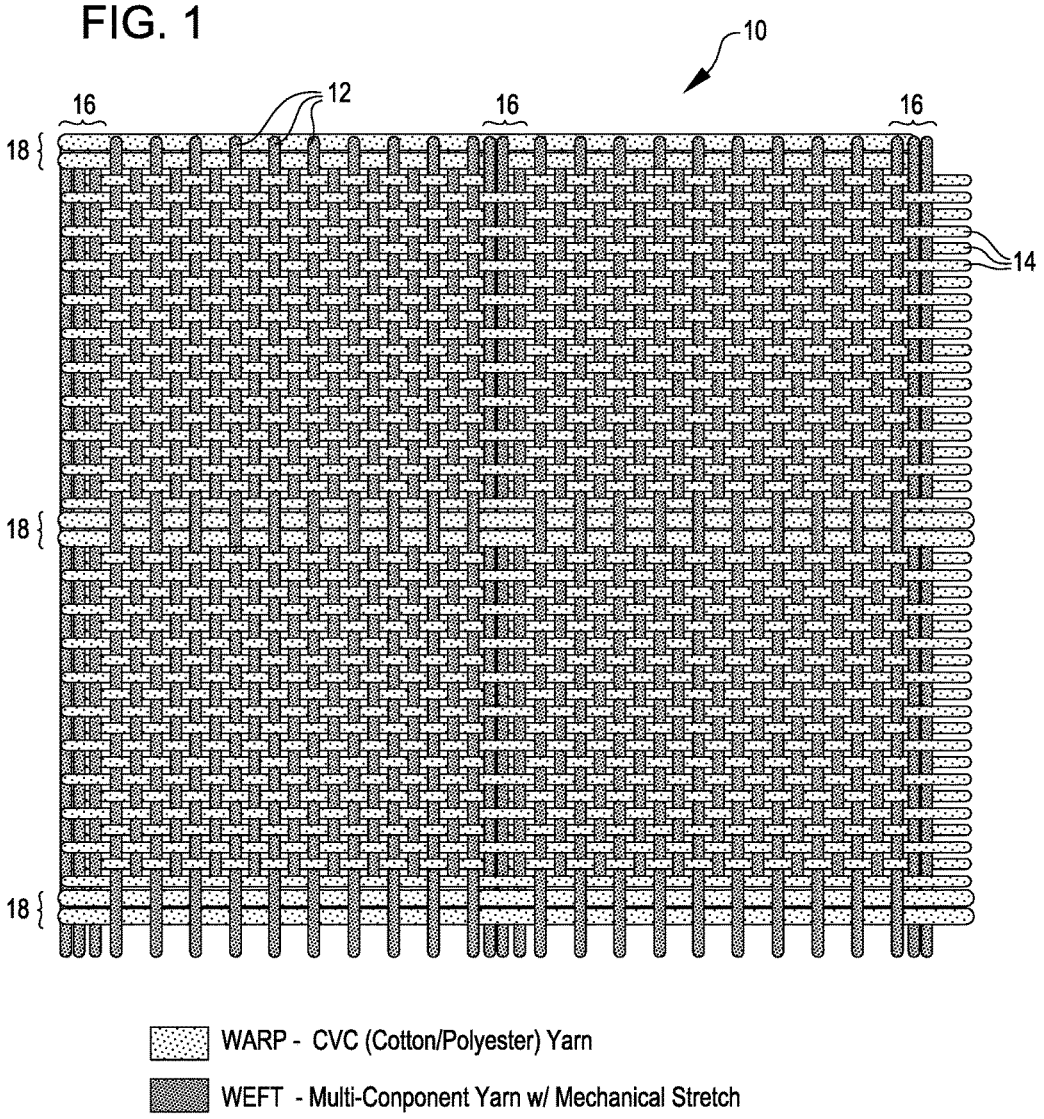
FIG. 1 is a representation of a first fabric in accordance with embodiments.

In at least some embodiments, a woven rip-stop fabric 10 (FIG. 1) is formed by weaving mechanical stretch weft yarns 12 into spun warp yarns 14. As shown in FIG. 1, to provide a rip-stop fabric weave, the mechanical stretch yarns 12 are interwoven through spun yarns 14 in a plain weave fashion. However, to provide strength and rip resistance, after predetermined intervals, two or more mechanical stretch yarns 12 are woven together (instead of each yarn alternating, as in regular plain weave) in the same pattern through the weft yarns. Such a variation in the pattern is shown generally at the areas 16 in FIG. 1. The pattern of weaving multiple (at least 2) adjacent weft yarns in the same weaving direction through the warp yarns is done in regular intervals. Similarly, the same one or more warp yarns may be skipped by each weft yarn during the weaving process, causing multiple spun warp yarns 12 to extend together, as shown generally at the areas 18 of the fabric 10 in FIG. 1. The pattern of weaving multiple adjacent weft yarns in the same weaving direction and skipping at least one weft yarn consistently during weaving can be done in regular intervals, providing a crosshatch pattern in the weave. The intervals are typically 3 to 8 millimeters, but may be altered to provide a desired function. In embodiments, the interval pattern in the weft direction is the same as the warp direction, so that the crosshatch forms repeating squares.

Alternatively, the mechanical stretch yarns 12 may be used as weft material, and the spun fibers 14 may be woven into the mechanical stretch yarns, forming a ripstop pattern.

After weaving, a stain and oil repellant finish is added during the finishing process to improve fade resistance and protect the woven fabric from stains. Again, the mechanical stretch properties of the fabric, as contrasted with the more common use of spandex in stretch fabrics, enables the rip-stop fabric of the present disclosure to withstand the high temperatures involved in this finishing process.

The novel ripstop fabrics described herein provides a fabric that can last many washes and that is highly suitable for police and military/militia wear, including pants or shirts. The pattern is resistant to wear, is capable of stretching for comfort, and can withstand multiple washes.

According to various embodiments, the fabric 10 shown in FIG. 1 may be formed of alternative combinations of yarns. In general, weaving the fabric 10 involves weaving weft yarns, formed from multiple fiber filaments (e.g., mechanical stretch yarns formed from multiple mechanical stretch filaments), into warp yarns formed from multiple staple fibers or staple fiber filaments. For example, in some embodiments, the fabric 10 can be formed of warp yarns employing entirely natural fibers or fiber blends, e.g. cotton, bamboo or other plant-based fibers, other natural fibers such as wool or wool blends and the like, polyester/wool blended fibers, or intimately blended combinations of any suitable subset of the above fibers. According to other embodiments, the fabric 10 can be formed of warp yarns employing entirely artificial fibers or fiber blends, e.g. artificial but nonsynthetic fibers such as rayon, or synthetic fibers such as nylon, polyester, acrylic, or polyolefin fibers. Various weft yarns can be used, including any suitable mechanical-stretch filament or yarn based on mechanical stretch filaments. For example, weft yarns can include bicomponent filament yarns including polyester bicomponent filaments, or side-by-side bicomponent yarns. According to various embodiments, at least one component material of the warp yarns and weft yarns may be shared, e.g., a polyester staple fiber or staple fiber blend including polyester as the warp yarn, and a polyester bicomponent filament or mechanical stretch yarn including polyester filaments, wherein the common material possesses similar dye retention, oil retention, or finish retention properties. According to some other examples the common material may be a nylon material, acrylic or modacrylic material, polyester material, or other fibrous material that can be incorporated in both a stretching filament and in a staple yarn. The weft yarns can include any suitable mechanical stretch yarn, such as a polyester bicomponent filament yarn, a polyester multicomponent filament yarn, a side-by-side yarn, or any suitable combination of mechanical stretch filaments.

According to some embodiments, one or more components of the staple fiber can be a protein fiber. Suitable protein fibers can include, but are not limited to, wool, silk, or the like. Protein fibers typically exhibit exceptional moisture absorbency and transport. In some specific embodiments, the spun yarns (e.g. warp yarns 14 where the spun yarn is in the warp, or weft yarns 12 where the spun yarn is in the weft) can be entirely or predominantly composed of protein fibers. In alternative embodiments, a spun yarn can contain a mixture of protein fibers as described herein with one or more additional staple yarns according to any of the examples discussed above.

According to certain embodiments, the mechanical stretch filament yarns may be interwoven in an unprotected fashion, i.e. without a wound covering fiber or companion fiber like those typically used to cover or to confer dye absorptive properties to elastic fibers.

According to some embodiments, the weft yarns, or the warp yarns, may be woven in a multi-ply configuration (e.g., may be doubled, or may be repeatedly doubled), to effectively thicken yarn. In some embodiments, the mechanical stretch filament yarns can be woven in a multi-ply configuration while the spun yarns are not, or the mechanical stretch filament yarns can be woven in a ply arrangement having a greater number of plies than the spun yarns, in order to match yarn thicknesses between the mechanical stretch filament yarns and the spun yarns. This matching can be used to improve the look and feel of the resulting fabric, and to increase the strength of the fabric in the direction of the mechanical stretch filament yarns (e.g., in the weft direction).

Figure 3:
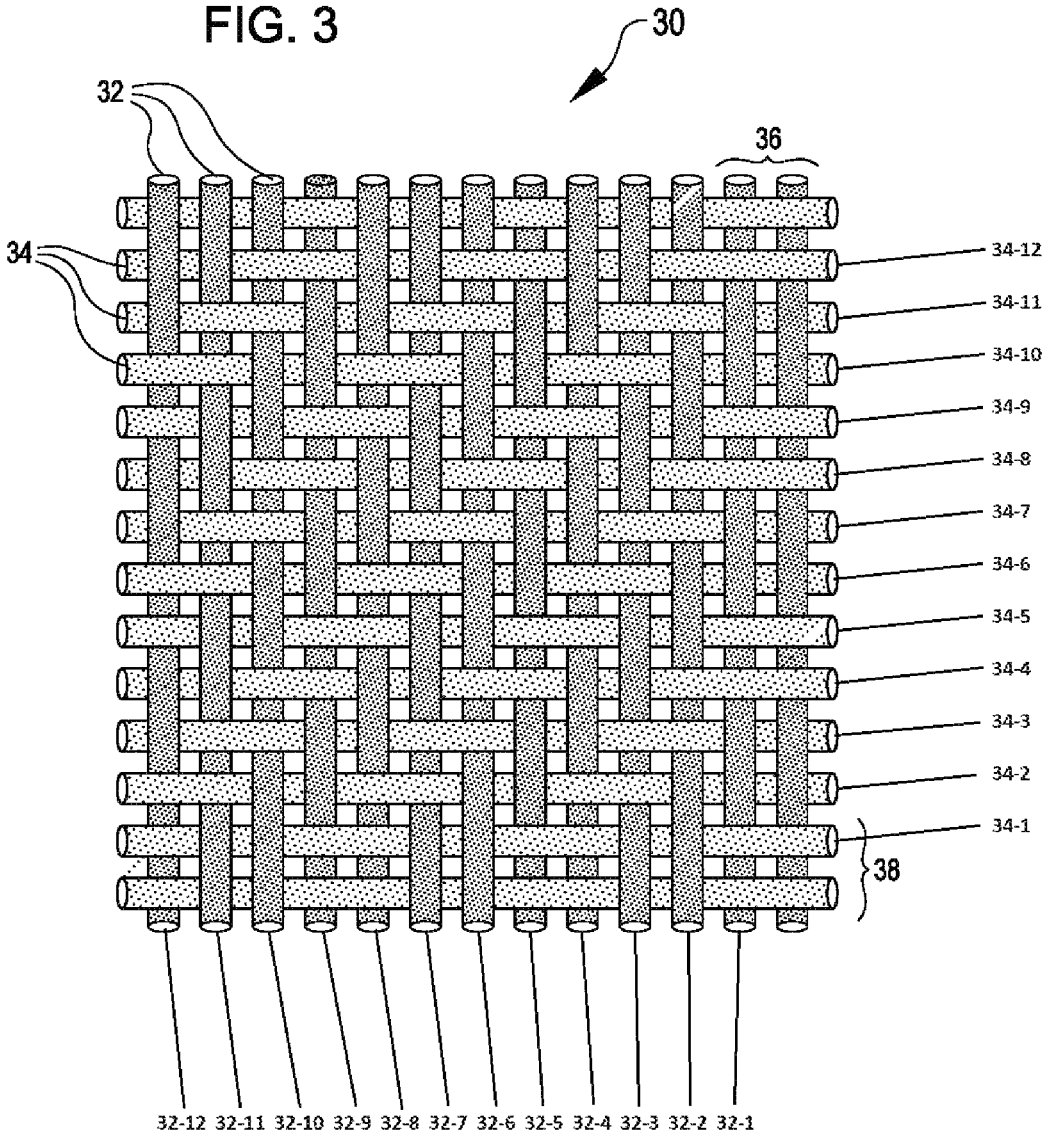
FIG. 3 is a representation of a third fabric in accordance with embodiments.
Figure 4:
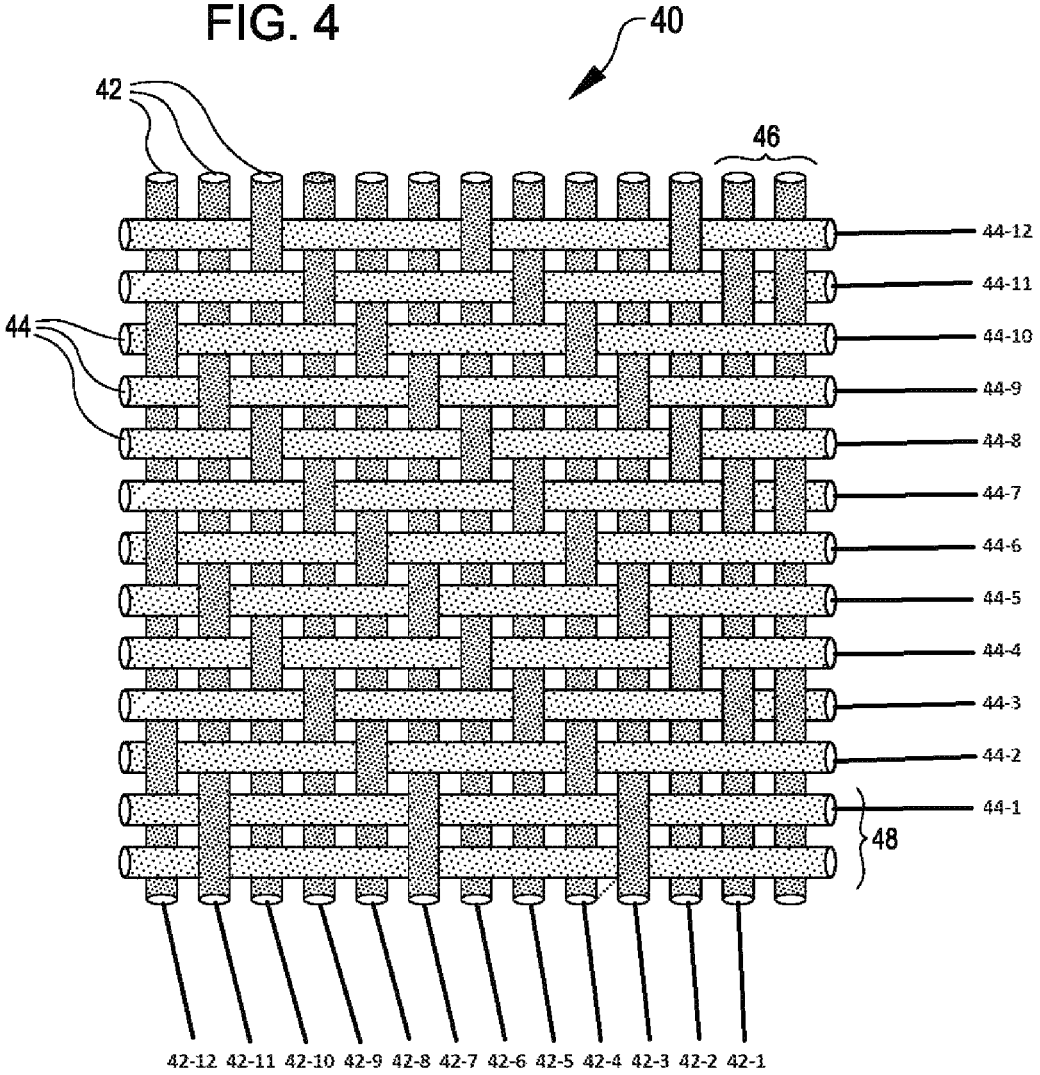
FIG. 4 is a representation of a fourth fabric in accordance with embodiments.

According to certain embodiments, the yarns described above for the weft of the fabric and the yarns described for the warp may be reversed, e.g., with mechanical stretch yarns used as warp yarns, and with staple yarns used as weft yarns and interwoven with the mechanical stretch yarns. Similarly, any suitable combination of the above-described yarns may be used as warp and weft yarns of weaves other than the simple woven rip-stop fabric 10 illustrated in FIG. 1. For example, FIGS. 2-4 illustrate various alternative fabric constructions that employ modified twill weaves including a ripstop pattern, according to certain embodiments.

In at least some embodiments, a modified woven twill 20 (FIG. 2) is formed by weaving mechanical stretch filament weft yarns 22 into spun warp yarns 24. As shown in FIG. 2, to provide a modified twill weave, the multi-component polyester filament yarns 22 are interwoven through spun yarns 24 in a 2×1 twill weave fashion, i.e., with each weft fiber woven over two and under one sequential warp fibers in a pattern that progresses by one fiber with each weft fiber. The weave includes a pattern that progresses by one fiber with each weft fiber, e.g., a first fiber will pass "over-over-under," an adjacent second fiber will pass "over-under-over", and a third fiber will pass, "under-over-over," before the pattern repeats. Among other advantages, twill weaves allow the color and/or character of each fiber to dominate on a respective surface of the fabric. For example, if one of the fibers is more wear-resistant or has better color retention, it may be desirable to use a 2×1 or 3×1 twill weave (see FIG. 4) to place that fiber predominantly at an outer surface of the fabric. Conversely, if one of the fibers provides a softer feel to the fabric, it may be desirable to place that fiber at an inner surface of the fabric.

The twill weave is modified to provide strength and rip resistance via addition of a ripstop pattern, as follows. After predetermined intervals, two or more mechanical stretch filament yarns 22 are woven together (breaking the progression of weft fibers as described above) in the same pattern through the weft yarns. Such a variation in the pattern is shown generally at the areas 26 in FIG. 2. The pattern of weaving multiple (at least 2, or more than 2) adjacent weft yarns in the same weaving direction through the warp yarns is done in regular intervals. Similarly, the same one or more warp yarns may be skipped by each weft yarn during the weaving process, causing multiple spun warp yarns 22 to extend together, as shown generally at the areas 28 of the fabric 20 in FIG. 2. The pattern of weaving multiple adjacent weft yarns in the same weaving direction and skipping at least one weft yarn consistently during weaving can be done in regular intervals, providing a crosshatch pattern in the weave. The intervals are typically 3 to 8 millimeters, but may be altered to provide a desired function. In some embodiments, the interval pattern in the weft direction is the same as the warp direction, so that the crosshatch forms repeating squares. The modified woven twill 20 can be combined with any suitable fiber combination as discussed above with reference to FIG. 1, and with any suitable yarn composition or configuration including, e.g., using multi-ply mechanical stretch fibers.

Figure 2:
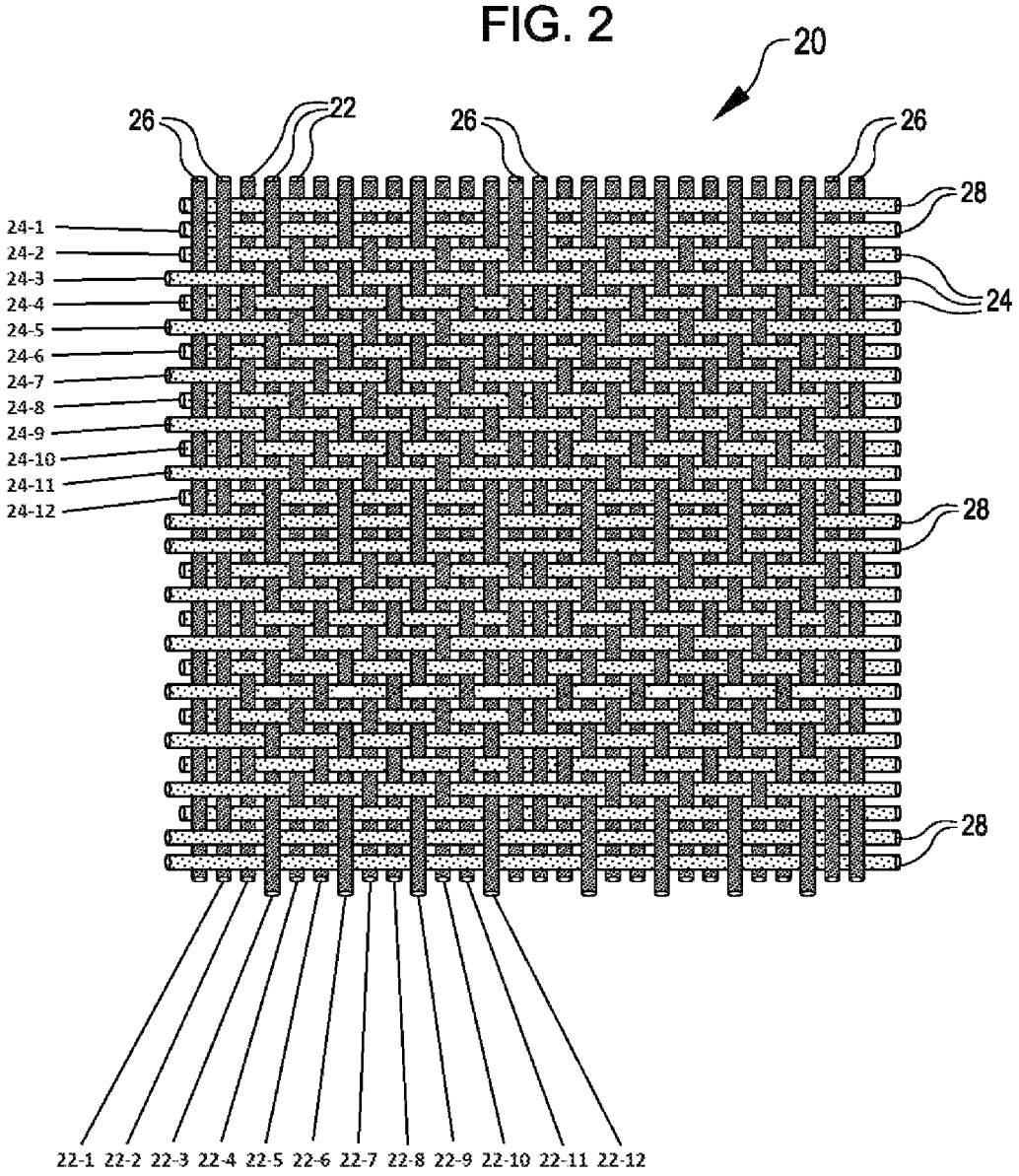
FIG. 2 is a representation of a second fabric in accordance with embodiments.

In the embodiment illustrated in FIG. 2, the modified woven twill 20 includes spun warp yarns 24, mechanical stretch weft yarns 22 interwoven into the spun warp yarns in a twill weave pattern, an additional mechanical stretch weft yarn that is woven together with a yarn of the mechanical stretch weft yarns, and an additional spun warp yarn that is woven together with a yarn of the spun warp yarns. In the embodiment of the modified woven twill 20 illustrated in FIG. 2: (a) the spun warp yarns include twelve of the spun warp yarns arranged sequentially from a first yarn 24-1 to a twelfth yarn 24-12 of the spun warp yarns 24; (b) the mechanical stretch weft yarns include twelve of the mechanical stretch weft yarns arranged sequentially from a first yarn 22-1 to a twelfth yarn 22-12 of the mechanical stretch weft yarns 22; (c) the first yarn 22-1 of the mechanical stretch weft yarns passes over each of the first, second, fourth, sixth, eight, tenth, and twelfth yarns of the spun warp yarns, and under each of the third, fifth, seventh, nineth, and eleventh yarns of the spun warp yarns; (d) the second yarn 22-2 of the mechanical stretch weft yarns passes under each of the first, second, third, fifth, seventh, nineth, and eleventh yarns of the spun warp yarns, and over each of the fourth, sixth, eighth, tenth, and twelfth yarns of the spun warp yarns; (e) the third yarn 22-3 of the mechanical stretch weft yarns passes over each of the first, third, sixth, ninth, and twelfth yarns of the spun warp yarns, and under each of the second, fourth, fifth, seventh, eighth, tenth, and eleventh yarns of the spun warp yarns; (f) the fourth yarn 22-4 of the mechanical stretch weft yarns passes under each of the first, third, sixth, seventh, nineth, tenth, and twelfth yarns of the spun warp yarns, and over each of the second, fifth, eighth, and eleventh yarns of the spun warp yarns; (g) the fifth yarn 22-5 of the mechanical stretch weft yarns passes under each of the first, second third, fifth, sixth, eighth, nineth, eleventh, and twelfth yarns of the spun warp yarns, and over each of the fourth, seventh, and tenth yarns of the spun warp yarns; (h) the sixth yarn 22-6 of the mechanical stretch weft yarns passes over each of the first, third, sixth, nineth, and twelfth yarns of the spun warp yarns, and under each of the second, fourth, fifth, seventh, eighth, tenth, and eleventh yarns of the spun warp yarns; (i) the seventh yarn 22-7 of the mechanical stretch weft yarns passes under each of the first, third, fourth, sixth, seventh, nineth, tenth, and twelfth yarns of the spun warp yarns, and over each of the second, fifth, eighth, and eleventh yarns of the spun warp yarns; (j) the eighth yarn 22-8 of the mechanical stretch weft yarns passes under each of the first, second third, fifth, sixth, eighth, nineth, eleventh, and twelfth yarns of the spun warp yarns, and over each of the fourth, seventh, and tenth yarns of the spun warp yarns; (k) the nineth yarn 22-9 of the mechanical stretch weft yarns passes over each of the first, third, sixth, nineth, and twelfth yarns of the spun warp yarns, and under each of the second, fourth, fifth, seventh, eighth, tenth, and eleventh yarns of the spun warp yarns; (l) the tenth yarn 22-10 of the mechanical stretch weft yarns passes under each of the first, third, fourth, sixth, seventh, nineth, tenth, and twelfth yarns of the spun warp yarns, and over each of the second fifth, eighth, and eleventh yarns of the spun warp yarns; (m) the eleventh yarn 22-11 of the mechanical stretch weft yarns passes under each of the first, second, third, fifth, sixth, eighth, nineth, eleventh, and twelfth yarns of the spun warp yarns, and over each of the second fifth, eighth, and eleventh yarns of the spun warp yarns; and (n) the twelfth yarn 22-12 of the mechanical stretch weft yarns passes over each of the first, third, sixth, nineth, and twelfth yarns of the spun warp yarns, and under each of the second, fourth, fifth, seventh, eighth, tenth, and eleventh yarns of the spun warp yarns.

In at least some embodiments, a second modified woven twill 30 (FIG. 3) is formed by weaving mechanical stretch filament weft yarns 32 into spun warp yarns 34. As shown in FIG. 3, to provide the modified twill weave, the multi-component polyester filament yarns 32 are interwoven through spun yarns 34 in a 2×2 twill weave fashion, i.e., with each weft fiber woven over two and under two sequential warp fibers. The weave includes a pattern that progresses by one fiber with each weft fiber, e.g., a first fiber will pass "over-over-under-under," an adjacent second fiber will pass "over-under-under-over", a third fiber will pass, "under-under-over-over," and a fourth fiber will pass, "under-over-over-under," before the pattern repeats. However, to provide strength and rip resistance, after predetermined intervals, two or more mechanical stretch filament yarns 32 are woven together (breaking the progression of weft fibers as described above) in the same pattern through the weft yarns. Such a variation in the pattern is shown generally at the areas 36 in FIG. 3. The pattern of weaving multiple (at least 2, or more than 2) adjacent weft yarns in the same weaving direction through the warp yarns is done in regular intervals. Similarly, the same one or more warp yarns may be skipped by each weft yarn during the weaving process, causing multiple spun warp yarns 32 to extend together, as shown generally at the areas 38 of the fabric 30 in FIG. 3. The pattern of weaving multiple adjacent weft yarns in the same weaving direction and skipping at least one weft yarn consistently during weaving can be done in regular intervals, providing a crosshatch pattern in the weave. The intervals are typically 3 to 8 millimeters, but may be altered to provide a desired function. In some embodiments, the interval pattern in the weft direction is the same as the warp direction, so that the crosshatch forms repeating squares. The modified woven twill 30 can be combined with any suitable fiber combination as discussed above with reference to FIG. 1, and with any suitable yarn composition or configuration including, e.g., using multi-ply mechanical stretch fibers.

In the embodiment illustrated in FIG. 3, the modified woven twill 30 includes spun warp yarns 34, mechanical stretch weft yarns 32 interwoven into the spun warp yarns in a twill weave pattern, an additional mechanical stretch weft yarn that is woven together with a yarn of the mechanical stretch weft yarns, and an additional spun warp yarn that is woven together with a yarn of the spun warp yarns. In the embodiment of the modified woven twill 30 illustrated in FIG. 3: (a) the spun warp yarns include twelve of the spun warp yarns arranged sequentially from a first yarn 34-1 to a twelfth yarn 34-12 of the spun warp yarns 34; (b) the mechanical stretch weft yarns include twelve of the mechanical stretch weft yarns arranged sequentially from a first yarn 32-1 to a twelfth yarn 32-12 of the mechanical stretch weft yarns 32; (c) the first yarn 32-1 of the mechanical stretch weft yarns passes under each of the first, fourth, fifth, eight, nineth, and twelfth yarns of the spun warp yarns, and over each of the second, third, sixth, seventh, tenth, and eleventh yarns of the spun warp yarns; (d) the second yarn 32-2 of the mechanical stretch weft yarns passes over each of the first, second, fifth, sixth, nineth, and tenth yarns of the spun warp yarns, and under each of the third, fourth, seventh, eighth, eleventh, and twelfth yarns of the spun warp yarns; (e) the third yarn 32-3 of the mechanical stretch weft yarns passes over each of the first, fourth, fifth, eight, nineth, and twelfth yarns of the spun warp yarns, and under each of the second, third, sixth, seventh, tenth, and eleventh yarns of the spun warp yarns; (f) the fourth yarn 32-4 of the mechanical stretch weft yarns passes under each of the first, second, fifth, sixth, nineth, and tenth yarns of the spun warp yarns, and over each of the third, fourth, seventh, eighth, eleventh, and twelfth yarns of the spun warp yarns; (g) the fifth yarn 32-5 of the mechanical stretch weft yarns passes under each of the first, fourth, fifth, eight, nineth, and twelfth yarns of the spun warp yarns, and over each of the second, third, sixth, seventh, tenth, and eleventh yarns of the spun warp yarns; (h) the sixth yarn 32-6 of the mechanical stretch weft yarns passes over each of the first, second, fifth, sixth, nineth, and tenth yarns of the spun warp yarns, and under each of the third, fourth, seventh, eighth, eleventh, and twelfth yarns of the spun warp yarns; (i) the seventh yarn 32-7 of the mechanical stretch weft yarns passes over each of the first, fourth, fifth, eight, nineth, and twelfth yarns of the spun warp yarns, and under each of the second, third, sixth, seventh, tenth, and eleventh yarns of the spun warp yarns; (j) the eighth yarn 32-8 of the mechanical stretch weft yarns passes under each of the first, second, fifth, sixth, nineth, and tenth yarns of the spun warp yarns, and over each of the third, fourth, seventh, eighth, eleventh, and twelfth yarns of the spun warp yarns; (k) the nineth yarn 32-9 of the mechanical stretch weft yarns passes under each of the first, fourth, fifth, eight, nineth, and twelfth yarns of the spun warp yarns, and over each of the second, third, sixth, seventh, tenth, and eleventh yarns of the spun warp yarns; (l) the tenth yarn 32-10 of the mechanical stretch weft yarns passes over each of the first, second, fifth, sixth, nineth, and tenth yarns of the spun warp yarns, and under each of the third, fourth, seventh, eighth, eleventh, and twelfth yarns of the spun warp yarns; (m) the eleventh yarn 32-11 of the mechanical stretch weft yarns passes over each of the first, fourth, fifth, eight, nineth, and twelfth yarns of the spun warp yarns, and under each of the second, third, sixth, seventh, tenth, and eleventh yarns of the spun warp yarns; and (n) the twelfth yarn 32-12 of the mechanical stretch weft yarns passes under each of the first, second, fifth, sixth, nineth, and tenth yarns of the spun warp yarns, and over each of the third, fourth, seventh, eighth, eleventh, and twelfth yarns of the spun warp yarns.

In at least some embodiments, a third modified woven twill 40 (FIG. 4) is formed by weaving mechanical stretch filament weft yarns 42 into spun warp yarns 44. As shown in FIG. 4, to provide the modified twill weave, the multi-component polyester filament yarns 42 are interwoven through spun yarns 44 in a 3×1 twill weave fashion, i.e., with each weft fiber woven over three and under one sequential warp fibers in a pattern that progresses by one fiber with each weft fiber. However, to provide strength and rip resistance, after predetermined intervals, two or more mechanical stretch filament yarns 42 are woven together (breaking the progression of weft fibers as described above) in the same pattern through the weft yarns. Such a variation in the pattern is shown generally at the areas 46 in FIG. 4. The pattern of weaving multiple (at least 2, or more than 2) adjacent weft yarns in the same weaving direction through the warp yarns is done in regular intervals. Similarly, the same one or more warp yarns may be skipped by each weft yarn during the weaving process, causing multiple spun warp yarns 42 to extend together, as shown generally at the areas 48 of the fabric 40 in FIG. 4. The pattern of weaving multiple adjacent weft yarns in the same weaving direction and skipping at least one weft yarn consistently during weaving can be done in regular intervals, providing a crosshatch pattern in the weave. The intervals are typically 4 to 8 millimeters, but may be altered to provide a desired function. In some embodiments, the interval pattern in the weft direction is the same as the warp direction, so that the crosshatch forms repeating squares. The modified woven twill 40 can be combined with any suitable fiber combination as discussed above with reference to FIG. 1, and with any suitable yarn composition or configuration including, e.g., using multi-ply mechanical stretch fibers.

In the embodiment illustrated in FIG. 4, the modified woven twill 40 includes spun warp yarns 44, mechanical stretch weft yarns 42 interwoven into the spun warp yarns in a twill weave pattern, an additional mechanical stretch weft yarn that is woven together with a yarn of the mechanical stretch weft yarns, and an additional spun warp yarn that is woven together with a yarn of the spun warp yarns. In the embodiment of the modified woven twill 40 illustrated in FIG. 4: (a) the spun warp yarns include twelve of the spun warp yarns arranged sequentially from a first yarn 44-1 to a twelfth yarn 44-12 of the spun warp yarns 44; (b) the mechanical stretch weft yarns include twelve of the mechanical stretch weft yarns arranged sequentially from a first yarn 42-1 to a twelfth yarn 42-12 of the mechanical stretch weft yarns; (c) the first yarn 42-1 of the mechanical stretch weft yarns passes under each of the first, second, fourth, fifth, sixth, eight, nineth, tenth, and twelfth yarns of the spun warp yarns, and over each of the third, seventh, and eleventh yarns of the spun warp yarns; (d) the second yarn 42-2 of the mechanical stretch weft yarns passes under each of the first, second, third, fifth, sixth, seventh, nineth, tenth, and eleventh yarns of the spun warp yarns, and over each of the fourth, eighth, and twelfth yarns of the spun warp yarns;

(e) the third yarn 42-3 of the mechanical stretch weft yarns passes over each of the first, fifth, and nineth yarns of the spun warp yarns, and under each of the second, third, fourth, sixth, seventh, eighth, tenth, eleventh, and twelfth yarns of the spun warp yarns; (f) the fourth yarn 42-4 of the mechanical stretch weft yarns passes under each of the first, third, fourth, fifth, seventh, eighth, nineth, eleventh, and twelfth yarns of the spun warp yarns, and over each of the second, sixth, and tenth yarns of the spun warp yarns; (g) the fifth yarn 42-5 of the mechanical stretch weft yarns passes under each of the first, second, fourth, fifth, sixth, eight, nineth, tenth, and twelfth yarns of the spun warp yarns, and over each of the third, seventh, and eleventh yarns of the spun warp yarns; (h) the sixth yarn 42-6 of the mechanical stretch weft yarns passes under each of the first, second, third, fifth, sixth, seventh, nineth, tenth, and eleventh yarns of the spun warp yarns, and over each of the fourth, eighth, and twelfth yarns of the spun warp yarns; (i) the seventh yarn 42-7 of the mechanical stretch weft yarns passes over each of the first, fifth, and nineth yarns of the spun warp yarns, and under each of the second, third, fourth, sixth, seventh, eighth, tenth, eleventh, and twelfth yarns of the spun warp yarns; (j) the eighth yarn 42-8 of the mechanical stretch weft yarns passes under each of the first, third, fourth, fifth, seventh, eighth, nineth, eleventh, and twelfth yarns of the spun warp yarns, and over each of the second, sixth, and tenth yarns of the spun warp yarns; (k) the nineth yarn 42-9 of the mechanical stretch weft yarns passes under each of the first, second, fourth, fifth, sixth, eight, nineth, tenth, and twelfth yarns of the spun warp yarns, and over each of the third, seventh, and eleventh yarns of the spun warp yarns; (l) the tenth yarn 42-10 of the mechanical stretch weft yarns passes under each of the first, second, third, fifth, sixth, seventh, nineth, tenth, and eleventh yarns of the spun warp yarns, and over each of the fourth, eighth, and twelfth yarns of the spun warp yarns; (m) the eleventh yarn 42-11 of the mechanical stretch weft yarns passes over each of the first, fifth, and nineth yarns of the spun warp yarns, and under each of the second, third, fourth, sixth, seventh, eighth, tenth, eleventh, and twelfth yarns of the spun warp yarns; and (n) the twelfth yarn 42-12 of the mechanical stretch weft yarns passes under each of the first, third, fourth, fifth, seventh, eighth, nineth, eleventh, and twelfth yarns of the spun warp yarns, and over each of the second, sixth, and tenth yarns of the spun warp yarns.

Figure 5:
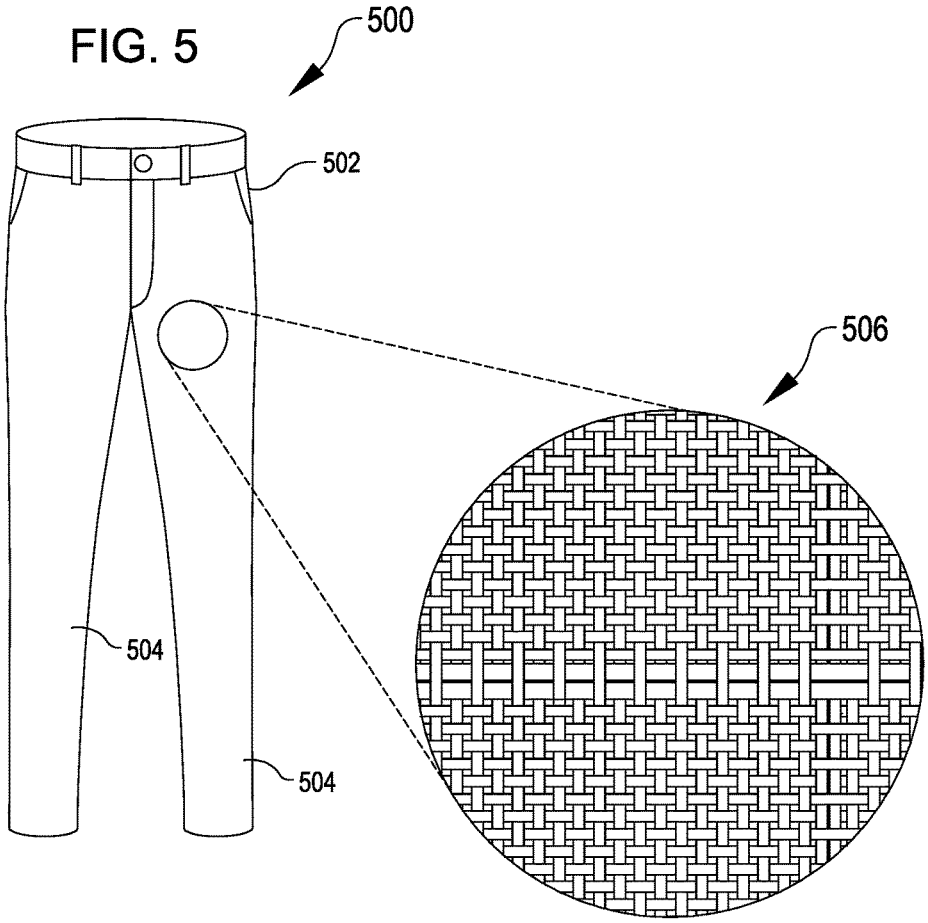
FIG. 5 illustrates pants employing a ripstop fabric with mechanical stretch fibers.

The various mechanical stretch ripstop fabrics and modified twill ripstop fabrics described above with respect to FIGS. 1-4 can be employed in the production of various clothing items, particularly those expected to see high degrees of wear and use, like outdoor wear, and police and military/militia wear, including pants or shirts. FIG. 5 illustrates an example of pants 500 formed predominantly using a mechanical stretch ripstop fabric 506. The pants 500 are formed having a waist portion 502 and two leg portions 504. The mechanical stretch ripstop fabric 506 shown is the same as the first, plain weave ripstop fabric 10 (FIG. 1), but it will be understood that the pants 500 can be made using any of the mechanical stretch ripstop fabrics 20, 30, 40 illustrated herein, and comparable fabrics, in accordance with various embodiments.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A ripstop fabric, comprising:

spun warp yarns;

mechanical stretch weft yarns interwoven into the spun warp yarns in a twill weave pattern in which:

the spun warp yarns comprise twelve of the spun warp yarns arranged sequentially from a first yarn to a twelfth yarn of the spun warp yarns;

the mechanical stretch weft yarns comprise twelve of the mechanical stretch weft yarns arranged sequentially from a first yarn to a twelfth yarn of the mechanical stretch weft yarns;

the first yarn of the mechanical stretch weft yarns passes over each of the first, second, fourth, sixth, eight, tenth, and twelfth instances yarns of the spun warp yarns, and under each of the third, fifth, seventh, nineth, and eleventh instances yarns of the spun warp yarns;

the second yarn of the mechanical stretch weft yarns passes under each of the first, second, third, fifth, seventh, nineth, and eleventh instances yarns of the spun warp yarns, and over each of the fourth, sixth, eighth, tenth, and twelfth yarns of the spun warp yarns;

the third yarn of the mechanical stretch weft yarns passes over each of the first, third, sixth, ninth, and twelfth yarns of the spun warp yarns, and under each of the second, fourth, fifth, seventh, eighth, tenth, and eleventh yarns of the spun warp yarns;

the fourth yarn of the mechanical stretch weft yarns passes under each of the first, third, sixth, seventh, nineth, tenth, and twelfth yarns of the spun warp yarns, and over each of the second, fifth, eighth, and eleventh yarns of the spun warp yarns;

the fifth yarn of the mechanical stretch weft yarns passes under each of the first, second third, fifth, sixth, eighth, nineth, eleventh, and twelfth yarns of the spun warp yarns, and over each of the fourth, seventh, and tenth yarns of the spun warp yarns;

the sixth yarn of the mechanical stretch weft yarns passes over each of the first, third, sixth, nineth, and twelfth yarns of the spun warp yarns, and under each of the second, fourth, fifth, seventh, eighth, tenth, and eleventh yarns of the spun warp yarns;

the seventh yarn of the mechanical stretch weft yarns passes under each of the first, third, fourth, sixth, seventh, nineth, tenth, and twelfth yarns of the spun warp yarns, and over each of the second, fifth, eighth, and eleventh yarns of the spun warp yarns;

the eighth yarn of the mechanical stretch weft yarns passes under each of the first, second third, fifth, sixth, eighth, nineth, eleventh, and twelfth yarns of the spun warp yarns, and over each of the fourth, seventh, and tenth yarns of the spun warp yarns;

the nineth yarn of the mechanical stretch weft yarns passes over each of the first, third, sixth, nineth, and twelfth yarns of the spun warp yarns, and under each of the second, fourth, fifth, seventh, eighth, tenth, and eleventh yarns of the spun warp yarns;

the tenth yarn of the mechanical stretch weft yarns passes under each of the first, third, fourth, sixth, seventh, nineth, tenth, and twelfth yarns of the spun warp yarns, and over each of the second fifth, eighth, and eleventh yarns of the spun warp yarns;

the eleventh yarn of the mechanical stretch weft yarns passes under each of the first, second, third, fifth, sixth, eighth, nineth, eleventh, and twelfth yarns of the spun warp yarns, and over each of the second fifth, eighth, and eleventh yarns of the spun warp yarns; and the twelfth yarn of the mechanical stretch weft yarns passes over each of the first, third, sixth, nineth, and twelfth yarns of the spun warp yarns, and under each of the second, fourth, fifth, seventh, eighth, tenth, and eleventh yarns of the spun warp yarns;

an additional mechanical stretch weft yarn that is woven together with a yarn of the twelve yarns of the mechanical stretch weft yarns; and an additional spun warp yarn that is woven together with a yarn of the twelve yarns of the spun warp yarns.

2. The ripstop fabric of claim 1, wherein the mechanical stretch yarns comprise multi-component polyester filament yarns or side-by-side mechanical stretch yarns.

3. The ripstop fabric of claim 1, wherein the spun yarns comprise protein fibers.

4. The ripstop fabric of claim 1, further comprising a stain and oil repellant finish that is added during a finishing process.

5. The ripstop fabric of claim 1, wherein each of the mechanical stretch yarns consists essentially of a multi-component polyester filament yarn.

6. A ripstop fabric, comprising:

spun warp yarns;

mechanical stretch weft yarns interwoven into the spun warp yarns in a twill weave pattern in which:

the spun warp yarns comprise twelve of the spun warp yarns arranged sequentially from a first yarn to a twelfth yarn of the spun warp yarns;

the mechanical stretch weft yarns comprise twelve of the mechanical stretch weft yarns arranged sequentially from a first yarn to a twelfth yarn of the mechanical stretch weft yarns;

the first yarn of the mechanical stretch weft yarns passes under each of the first, fourth, fifth, eight, nineth, and twelfth yarns of the spun warp yarns, and over each of the second, third, sixth, seventh, tenth, and eleventh yarns of the spun warp yarns;

the second yarn of the mechanical stretch weft yarns passes over each of the first, second, fifth, sixth, nineth, and tenth yarns of the spun warp yarns, and under each of the third, fourth, seventh, eighth, eleventh, and twelfth yarns of the spun warp yarns;

the third yarn of the mechanical stretch weft yarns passes over each of the first, fourth, fifth, eight, nineth, and twelfth yarns of the spun warp yarns, and under each of the second, third, sixth, seventh, tenth, and eleventh yarns of the spun warp yarns;

the fourth yarn of the mechanical stretch weft yarns passes under each of the first, second, fifth, sixth, nineth, and tenth yarns of the spun warp yarns, and over each of the third, fourth, seventh, eighth, eleventh, and twelfth yarns of the spun warp yarns;

the fifth yarn of the mechanical stretch weft yarns passes under each of the first, fourth, fifth, eight, nineth, and twelfth yarns of the spun warp yarns, and over each of the second, third, sixth, seventh, tenth, and eleventh yarns of the spun warp yarns;

the sixth yarn of the mechanical stretch weft yarns passes over each of the first, second, fifth, sixth, nineth, and tenth yarns of the spun warp yarns, and under each of the third, fourth, seventh, eighth, eleventh, and twelfth yarns of the spun warp yarns;

the seventh yarn of the mechanical stretch weft yarns passes over each of the first, fourth, fifth, eight, nineth, and twelfth yarns of the spun warp yarns, and under each of the second, third, sixth, seventh, tenth, and eleventh yarns of the spun warp yarns;

the eighth yarn of the mechanical stretch weft yarns passes under each of the first, second, fifth, sixth, nineth, and tenth yarns of the spun warp yarns, and over each of the third, fourth, seventh, eighth, eleventh, and twelfth yarns of the spun warp yarns;

the nineth yarn of the mechanical stretch weft yarns passes under each of the first, fourth, fifth, eight, nineth, and twelfth yarns of the spun warp yarns, and over each of the second, third, sixth, seventh, tenth, and eleventh yarns of the spun warp yarns;

the tenth yarn of the mechanical stretch weft yarns passes over each of the first, second, fifth, sixth, nineth, and tenth yarns of the spun warp yarns, and under each of the third, fourth, seventh, eighth, eleventh, and twelfth yarns of the spun warp yarns;

the eleventh yarn of the mechanical stretch weft yarns passes over each of the first, fourth, fifth, eight, nineth, and twelfth yarns of the spun warp yarns, and under each of the second, third, sixth, seventh, tenth, and eleventh yarns of the spun warp yarns; and the twelfth yarn of the mechanical stretch weft yarns passes under each of the first, second, fifth, sixth, nineth, and tenth yarns of the spun warp yarns, and over each of the third, fourth, seventh, eighth, eleventh, and twelfth yarns of the spun warp yarns;

an additional mechanical stretch weft yarn that is woven together with a yarn of the twelve yarns of the mechanical stretch weft yarns; and an additional spun warp yarn that is woven together with a yarn of the twelve yarns of the spun warp yarns.

7. The ripstop fabric of claim 6, wherein the mechanical stretch yarns comprise multi-component polyester filament yarns or side-by-side mechanical stretch yarns.

8. The ripstop fabric of claim 6, wherein the spun yarns comprise protein fibers.

9. The ripstop fabric of claim 6, further comprising a stain and oil repellant finish that is added during a finishing process.

10. A ripstop fabric, comprising:

spun warp yarns;

mechanical stretch weft yarns interwoven into the spun warp yarns in a twill weave pattern in which:

the spun warp yarns comprise twelve of the spun warp yarns arranged sequentially from a first yarn to a twelfth yarn of the spun warp yarns;

the mechanical stretch weft yarns comprise twelve of the mechanical stretch weft yarns arranged sequentially from a first yarn to a twelfth yarn of the mechanical stretch weft yarns;

the first yarn of the mechanical stretch weft yarns passes under each of the first, second, fourth, fifth, sixth, eight, nineth, tenth, and twelfth yarns of the spun warp yarns, and over each of the third, seventh, and eleventh yarns of the spun warp yarns;

the second yarn of the mechanical stretch weft yarns passes under each of the first, second, third, fifth, sixth, seventh, nineth, tenth, and eleventh yarns of the spun warp yarns, and over each of the fourth, eighth, and twelfth yarns of the spun warp yarns;

the third yarn of the mechanical stretch weft yarns passes over each of the first, fifth, and nineth yarns of the spun warp yarns, and under each of the second, third, fourth, sixth, seventh, eighth, tenth, eleventh, and twelfth yarns of the spun warp yarns;

the fourth yarn of the mechanical stretch weft yarns passes under each of the first, third, fourth, fifth, seventh, eighth, nineth, eleventh, and twelfth yarns of the spun warp yarns, and over each of the second, sixth, and tenth yarns of the spun warp yarns;

the fifth yarn of the mechanical stretch weft yarns passes under each of the first, second, fourth, fifth, sixth, eight, nineth, tenth, and twelfth yarns of the spun warp yarns, and over each of the third, seventh, and eleventh yarns of the spun warp yarns;

the sixth yarn of the mechanical stretch weft yarns passes under each of the first, second, third, fifth, sixth, seventh, nineth, tenth, and eleventh yarns of the spun warp yarns, and over each of the fourth, eighth, and twelfth yarns of the spun warp yarns;

the seventh yarn of the mechanical stretch weft yarns passes over each of the first, fifth, and nineth yarns of the spun warp yarns, and under each of the second, third, fourth, sixth, seventh, eighth, tenth, eleventh, and twelfth yarns of the spun warp yarns;

the eighth yarn of the mechanical stretch weft yarns passes under each of the first, third, fourth, fifth, seventh, eighth, nineth, eleventh, and twelfth yarns of the spun warp yarns, and over each of the second, sixth, and tenth yarns of the spun warp yarns;

the nineth yarn of the mechanical stretch weft yarns passes under each of the first, second, fourth, fifth, sixth, eight, nineth, tenth, and twelfth yarns of the spun warp yarns, and over each of the third, seventh, and eleventh yarns of the spun warp yarns;

the tenth yarn of the mechanical stretch weft yarns passes under each of the first, second, third, fifth, sixth, seventh, nineth, tenth, and eleventh yarns of the spun warp yarns, and over each of the fourth, eighth, and twelfth yarns of the spun warp yarns;

the eleventh yarn of the mechanical stretch weft yarns passes over each of the first, fifth, and nineth yarns of the spun warp yarns, and under each of the second, third, fourth, sixth, seventh, eighth, tenth, eleventh, and twelfth yarns of the spun warp yarns;

the twelfth yarn of the mechanical stretch weft yarns passes under each of the first, third, fourth, fifth, seventh, eighth, nineth, eleventh, and twelfth yarns of the spun warp yarns, and over each of the second, sixth, and tenth yarns of the spun warp yarns;

an additional mechanical stretch weft yarn that is woven together with a yarn of the twelve yarns of the mechanical stretch weft yarns; and an additional spun warp yarn that is woven together with a yarn of the twelve yarns of the spun warp yarns.

11. The ripstop fabric of claim 10, wherein the mechanical stretch yarns comprise multi-component polyester filament yarns or side-by-side mechanical stretch yarns.

12. The ripstop fabric of claim 10, wherein the spun yarns comprise protein fibers.

13. The ripstop fabric of claim 10, further comprising a stain and oil repellant finish that is added during a finishing process.

* * * * *